US006945140B2

(12) United States Patent
Gibbons et al.

(10) Patent No.: US 6,945,140 B2
(45) Date of Patent: Sep. 20, 2005

(54) AUTOMATIC SCREWFEEDER

(75) Inventors: Louis A. Gibbons, Stevensville, MD (US); David C. Campbell, Bel Air, MD (US); Rod Muir, South Mountain (CA); Aldo Balatti, Greely (CA)

(73) Assignee: Black & Decker Inc., Newark, DE (US)

( * ) Notice: Subject to any disclaimer, the term of this patent is extended or adjusted under 35 U.S.C. 154(b) by 34 days.

(21) Appl. No.: 10/646,464

(22) Filed: Aug. 21, 2003

(65) Prior Publication Data

US 2005/0039580 A1 Feb. 24, 2005

(51) Int. Cl.[7] ..... B25B 23/06

(52) U.S. Cl. ..... 81/57.37; 81/431

(58) Field of Search ..... 81/57, 57.22, 57.23, 81/57.37, 431, 433

(56) References Cited

U.S. PATENT DOCUMENTS

| | | | | | |
|---|---|---|---|---|---|
| 1,793,236 | A | * | 2/1931 | McDonough | 81/57.37 |
| 1,945,741 | A | * | 2/1934 | Gray | 7/165 |
| 2,261,134 | A | | 11/1941 | Blair | |
| 3,526,257 | A | * | 9/1970 | Kirkland | 81/431 |
| 3,656,520 | A | * | 4/1972 | Caffa | 81/430 |
| 3,907,014 | A | * | 9/1975 | Manino | 81/433 |
| 3,960,191 | A | | 6/1976 | Murray | |
| 4,354,403 | A | | 10/1982 | Boegel et al. | |
| 4,397,412 | A | | 8/1983 | Dewey | |
| 4,416,172 | A | | 11/1983 | Medinger | |
| 4,510,826 | A | | 4/1985 | Marks | |
| 4,674,367 | A | * | 6/1987 | Aab et al. | 81/57.37 |
| 4,784,026 | A | | 11/1988 | Kobayashi et al. | |
| 4,998,452 | A | * | 3/1991 | Blum | 81/57.37 |
| 5,027,679 | A | * | 7/1991 | Kawashima et al. | 81/434 |
| 5,044,519 | A | | 9/1991 | Aoyama | |
| 5,101,697 | A | * | 4/1992 | Fishback | 81/434 |
| 5,186,084 | A | * | 2/1993 | Totsu | 81/431 |
| 5,193,729 | A | | 3/1993 | Dewey et al. | |
| 5,199,506 | A | | 4/1993 | Dewey et al. | |
| 5,199,625 | A | | 4/1993 | Dewey et al. | |
| 5,231,900 | A | * | 8/1993 | Deri | 81/57.37 |
| 5,295,295 | A | | 3/1994 | Aoyama | |
| 5,531,142 | A | * | 7/1996 | Adamo | 81/434 |
| 5,660,090 | A | * | 8/1997 | Deri | 81/434 |
| D383,656 | S | | 9/1997 | Muro | |
| D387,963 | S | | 12/1997 | Clark | |
| D389,028 | S | | 1/1998 | Muro | |
| 5,706,708 | A | * | 1/1998 | Refalo et al. | 81/57.37 |
| 5,740,705 | A | | 4/1998 | Graham | |
| D403,940 | S | | 1/1999 | Steinfeldt | |
| 5,921,454 | A | | 7/1999 | Larson et al. | |
| 5,960,678 | A | | 10/1999 | Kennedy | |
| 6,138,535 | A | * | 10/2000 | Jalbert et al. | 81/434 |
| 6,142,352 | A | | 11/2000 | Larson et al. | |
| D438,769 | S | | 3/2001 | Deziel | |
| 6,296,064 | B1 | * | 10/2001 | Janusz et al. | 173/30 |
| 6,439,085 | B1 | | 8/2002 | Habermehl et al. | |
| 6,622,596 | B2 | | 9/2003 | Janusz et al. | |
| 6,729,522 | B2 | * | 5/2004 | Hempfling et al. | 227/119 |

FOREIGN PATENT DOCUMENTS

| | | |
|---|---|---|
| DE | 69 27 024 | 11/1969 |
| DE | P 19 61 216.9 | 9/1970 |
| DE | P 26 24 441.7 | 12/1976 |
| DE | 33 28 730 | 3/1984 |
| DE | M 89 03 687 | 5/1989 |

(Continued)

*Primary Examiner*—David B. Thomas
(74) *Attorney, Agent, or Firm*—Harness, Dickey & Pierce, P.L.C.

(57) ABSTRACT

An automatic screwfeeder is adapted for use with a hand drill. The automatic screwfeeder operates to transfer uncollated screws from a screw holder into a staged position. A driving bit sequentially engages individual fasteners and drives them into a workpiece. The screwfeeder includes a front assembly separable from a rear assembly to allow replacement of the driving bit.

29 Claims, 11 Drawing Sheets

FOREIGN PATENT DOCUMENTS

| | | |
|---|---|---|
| DE | 39 34 900 | 4/1990 |
| DE | M 90 05 602 | 4/1990 |
| DE | M 92 01 773 | 9/1991 |
| DE | M 96 03 463 | 11/1995 |
| DE | 35 42 702 | 10/1996 |
| DE | 400 06 349 | 4/2000 |
| DE | 200 23 108 | 4/2003 |
| EP | 0 491 484 | 6/1992 |
| EP | 0 535 826 | 4/1993 |
| EP | 0 541 290 | 5/1993 |
| EP | 0 547 638 | 6/1993 |
| EP | 0 955 425 | 11/1999 |

* cited by examiner

AUTOMATIC SCREWFEEDER

BACKGROUND OF THE INVENTION

The present invention relates generally to a power screwdriver and, more particularly, to an automatic screwfeeder mechanism for attachment to a conventional hand drill.

A number of fastener installation tools have been adapted to sequentially install fasteners to a workpiece. Typically, the fasteners are interconnected to one another with a web which is subsequently discarded after the fastener has been installed. Unfortunately, the cost and availability of collated and interconnected fasteners is prohibitive to widespread use of such devices.

SUMMARY OF THE INVENTION

Accordingly, it is an object of the present invention to provide an automatic screwfeeder for use with a conventional hand drill that does not require collated fasteners.

It is another object of the present invention to provide an automatic screwfeeder including a substantially translucent access cover to allow an operator to view fed fasteners and clear jams should they occur.

It is another object of the present invention to provide an automatic screwfeeder having a body axially moveable relative to a sliding core where the body includes a camming surface selectively engageable with a toggle. The toggle is adapted to retain fasteners in a pre-staged area and allow individual fasteners to enter a staging area once the previously staged fastener has been driven.

It is another object of the present invention to provide a fastener engaging device such that an operator must input a predetermined load greater than the weight of the automatic screwfeeder to begin driving a fastener. This feature assures that inadvertent screw feeding and/or driving does not occur.

It is another object of the present invention to provide an automatic screwfeeder having a front assembly separable from a rear assembly. A driving bit is rotatably supported on the front assembly and may be replaced by disconnecting the front and rear assemblies.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
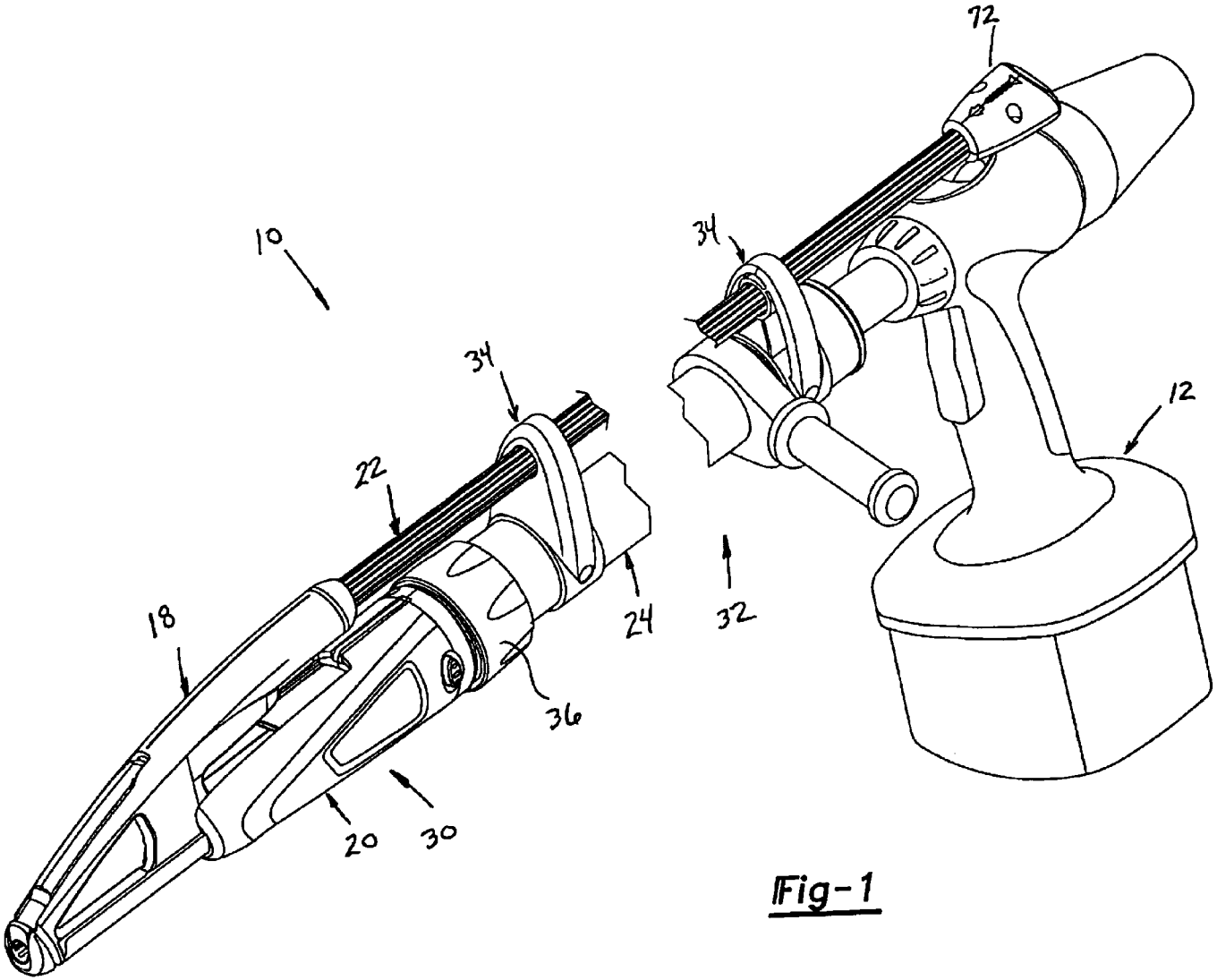
FIG. 1 is a fragmentary perspective view of an exemplary hand drill coupled to an automatic screwfeeder of the present invention.
Figure 2:
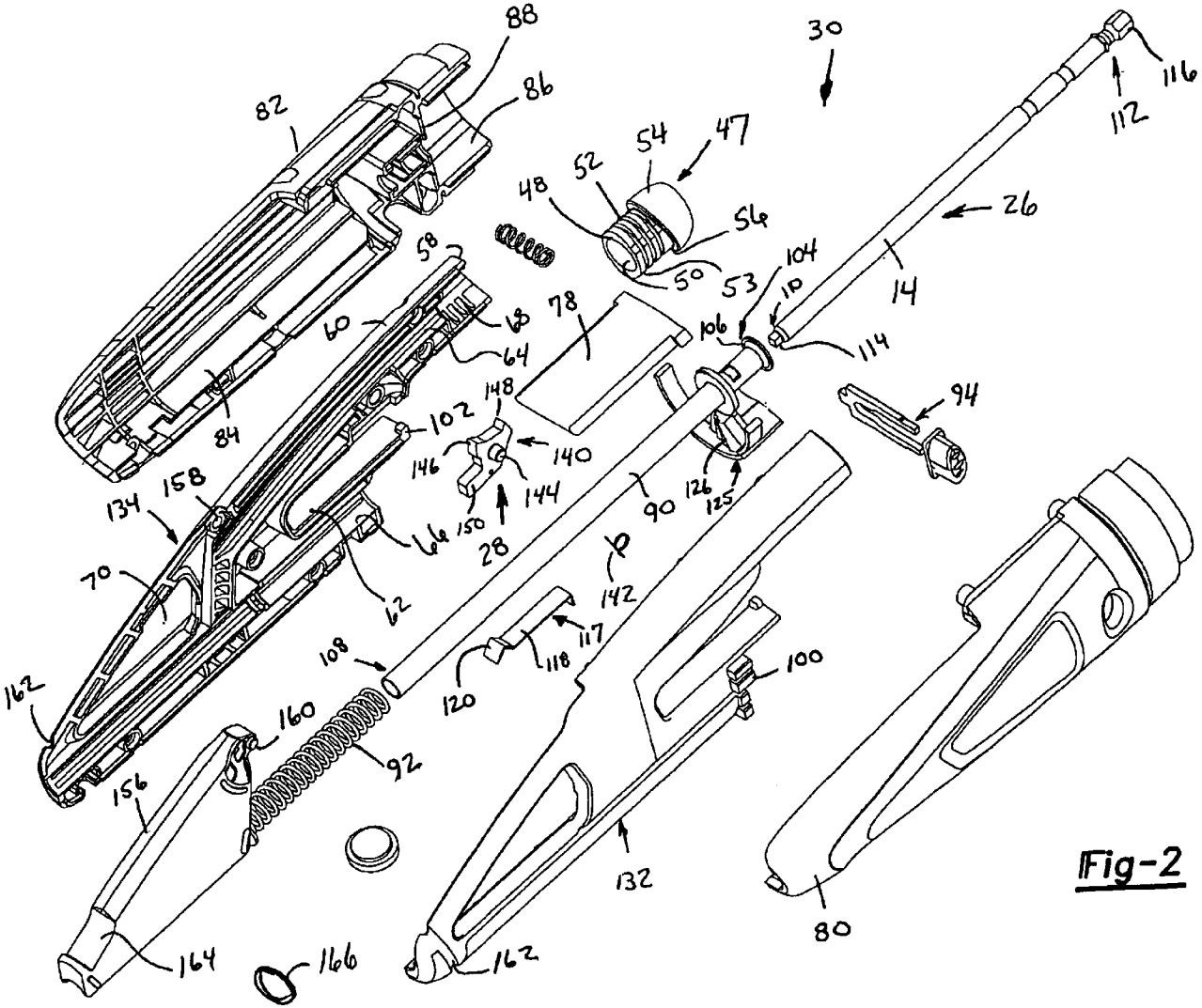
FIG. 2 is a partial exploded perspective view of a front assembly of the automatic screwfeeder of the present invention.
Figure 3:
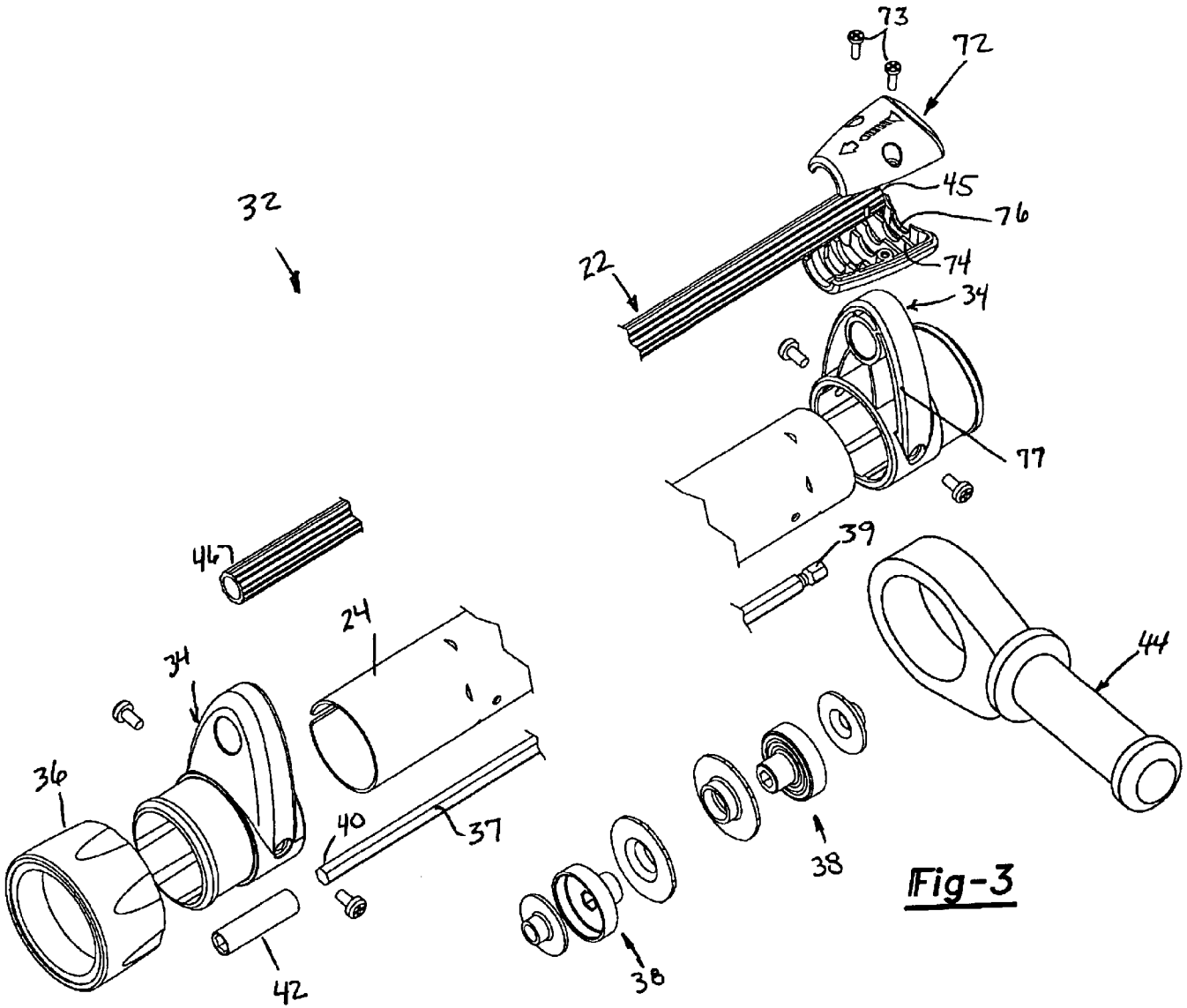
FIG. 3 is a fragmentary exploded perspective view of a rear assembly of the automatic screwfeeder of the present invention.

Referring to FIGS. 1–3, an automatic screwfeeder 10 is shown coupled to an exemplary hand drill 12. Hand drill 12 is drivingly engageable with screwfeeder 10 to transfer torque to a bit 14. Screwfeeder 10 is operable to consecutively drive non-collated screws 16 (FIG. 7) into a workpiece such as a floor without requiring the operator to manually feed each fastener to be installed.

Screwfeeder 10 includes a sliding core 18, a body 20, a screw accumulation tube 22, an extension tube 24, a drive mechanism 26 and a feeder mechanism 28. Body 20 and sliding core 18 form a front assembly 30 which is separable from a rear assembly 32. Rear assembly 32 includes screw accumulation tube 22, extension tube 24, and a pair of clamps 34 interconnecting extension tube 24 and screw accumulation tube 22. A nut 36 is rotatably captured on the end of extension tube 24. Nut 36 is threadingly engagable with body 20 to couple front assembly 30 to rear assembly 32. Rear assembly 32 and front assembly 30 are separated from one another to replace bit 14.

A driveshaft 37 is rotatably supported within extension tube 24 by a pair of bushing assemblies 38. Driveshaft 37 includes a hexagonally shaped first end 39 which is selectively engageble by an output member of hand drill 12. Driveshaft 37 includes a second end 40 which is also hexagonally shaped. Second end 40 is drivingly engaged with a coupling 42. Coupling 42 drivingly interconnects driveshaft 37 and bit 14. A handle 44 is coupled to extension tube 24 to assist an operator in applying an axial force to automatic screwfeeder 10 during a screw driving operation.

Screw accumulation tube 22 includes a first end 45 and a second end 46. Second end 46 is coupled to sliding core 18 by a grommet 47. Grommet 47 includes a substantially cylindrical body 48 having an aperture 50 axially extending therethrough. A plurality of ribs 52 radially extend from an outer surface 53 of body 48. An enlarged head 54 is positioned at one end of grommet 47. Head 54 defines an annular surface 56 which engages an end face 58 of sliding core 18. Specifically, sliding core 18 is bifurcated to include a first housing portion 60 spaced apart from a second housing portion 62. First housing portion 60 defines a screw feed track 64. Second housing portion 62 defines a portion of a bore 66. First housing portion 60 includes a plurality of recesses 68 for receipt of ribs 52. Screw feed track 64 intersects bit bore 66 at nose cavity 70. Preferably, second end 46 of screw accumulation tube 22 is press fit within grommet 47 to interconnect screw accumulation tube 22 and sliding core 18.

Figure 11:
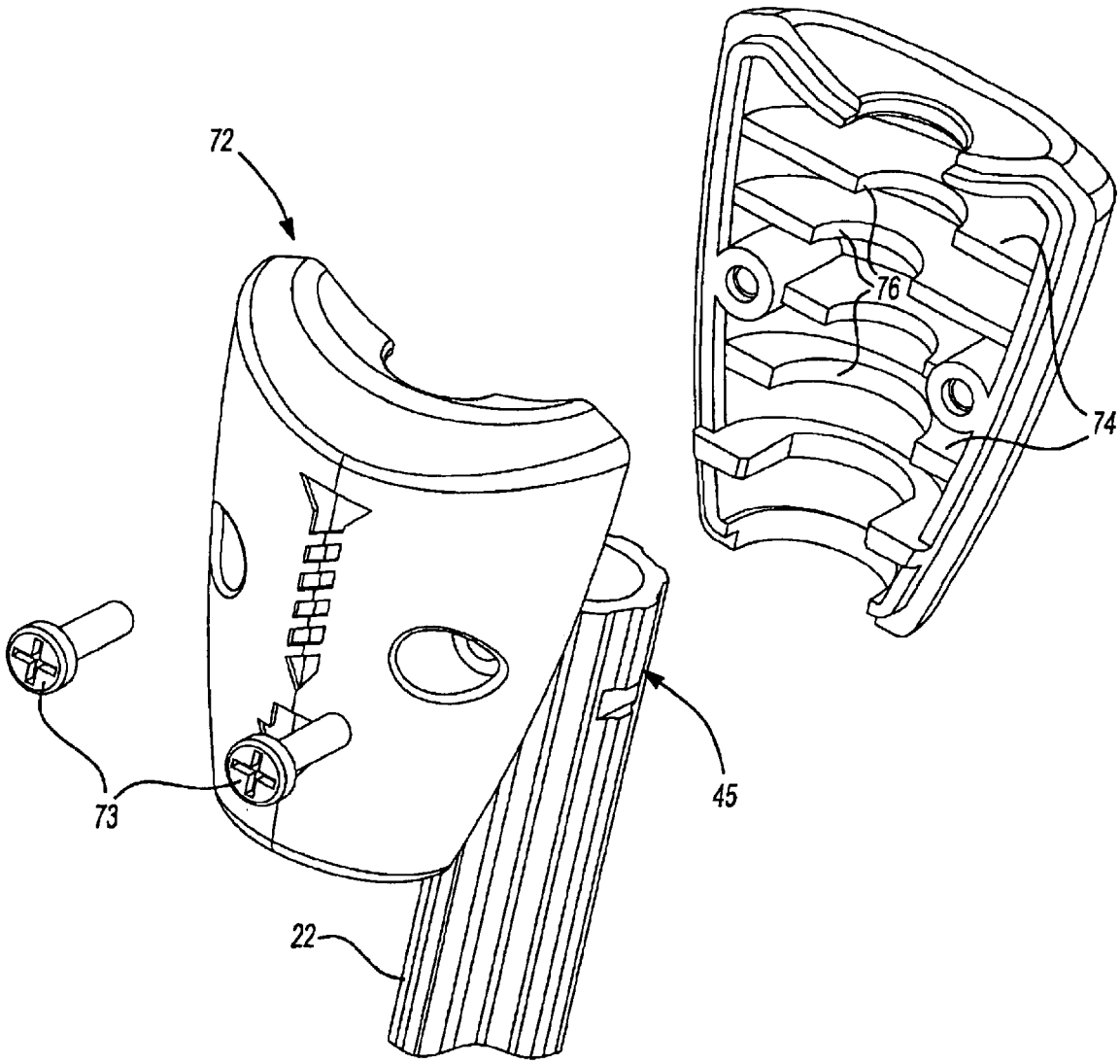
FIG. 11 is an exploded perspective view of the filter of the present invention.

A filter 72 is coupled to first end 45 of screw accumulation tube 22. Filter 72 is a two-part assembly coupled to screw accumulation tube 22 via fasteners 73. As best shown in FIG. 11, filter 72 includes a plurality of ribs 74 including apertures 76 extending therethrough. Apertures 76 are offset from one another to define a serpentine path for screws 16 to follow. This serpentine path functions to greatly increase the difficulty of insertion of a screw head first instead of in the proper direction of tip first. Additionally, ribs 74 resist backflow of screws 16 if an operator should invert screwfeeder 10 to a position where gravity forces the screws toward filter 72.

Figure 4:
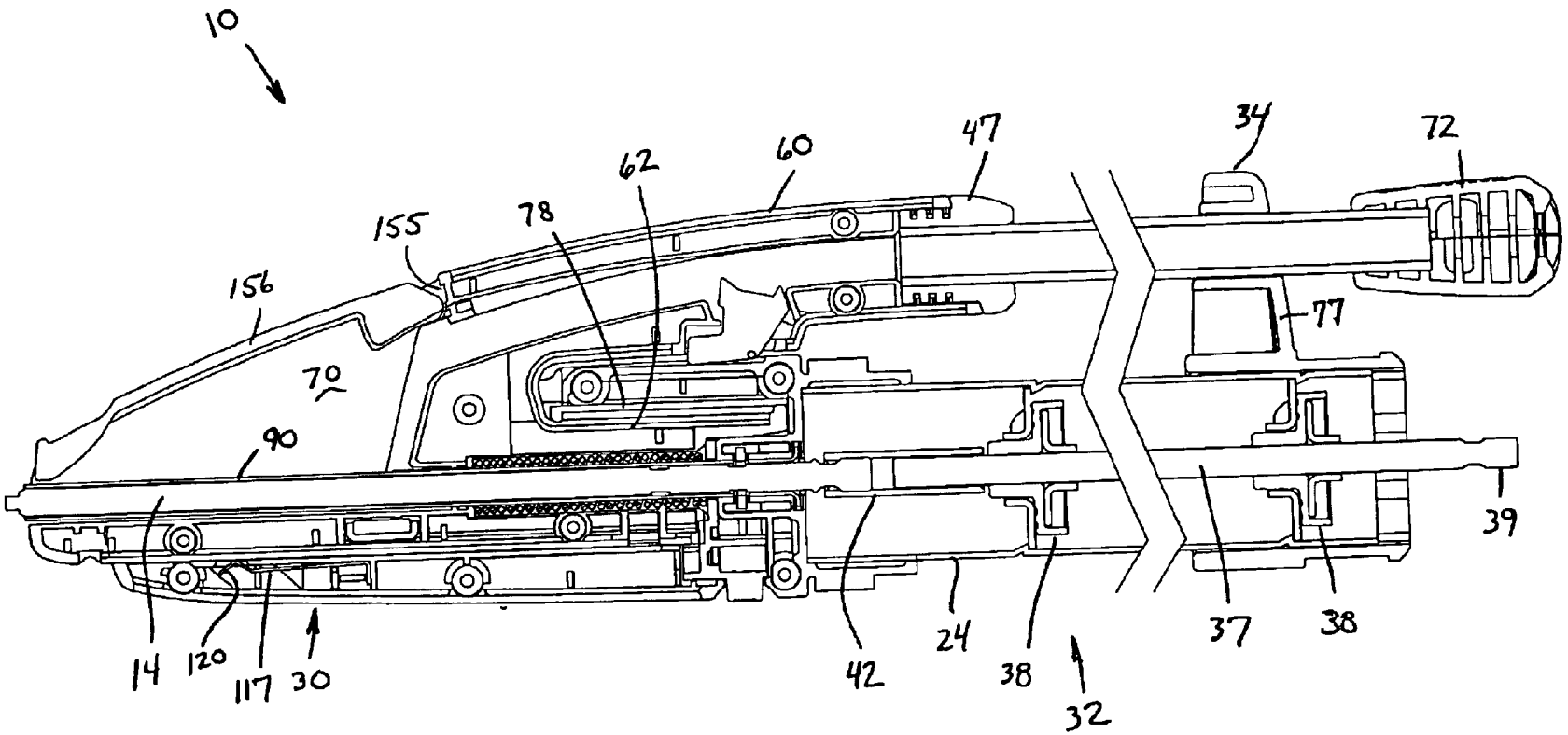
FIG. 4 is a fragmentary cross-sectional side view of the automatic screwfeeder of the present invention.
Figure 7:
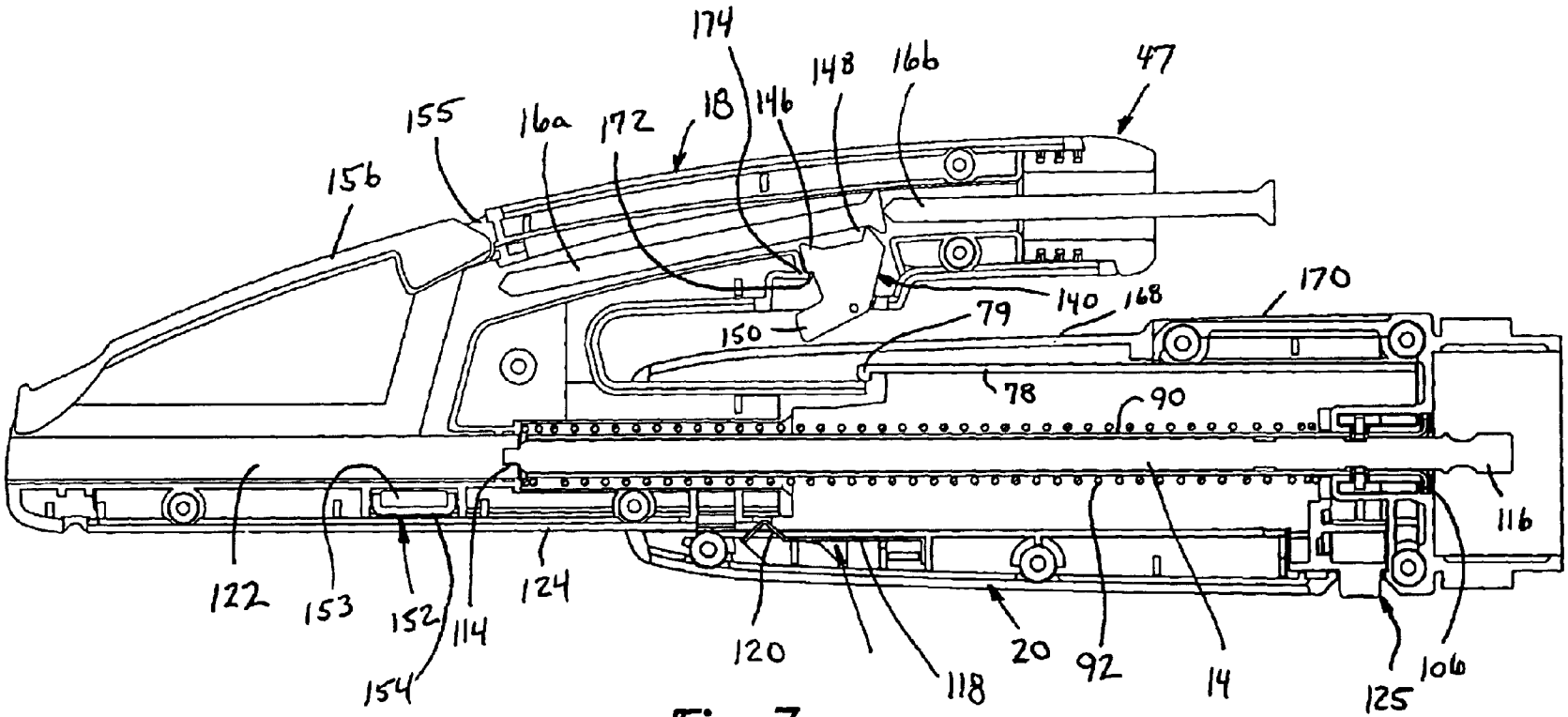
FIGS. 7–10 are partial cross-sectional side views depicted non-actuated positions of the automatic screwfeeder of the present invention.

Sliding core 18 is axially movable relative to body 20 between a collapsed position shown in FIG. 4 and an extended position shown in FIG. 7. To accommodate the relative motion of the components, clamps 34 include supports 77 which are coupled to screw accumulation tube 22 in a slip-fit manner. Accordingly, screw accumulation tube 22 axially translates with sliding core 18 and moves relative to extension tube 24 and body 20.

A panel 78 is slidably positioned between sliding core 18 and body 20. Panel 78 translates during movement of sliding core 18 to assure that an additional opening is not formed in front assembly 30 during operation. When sliding core 18 is in the extended position, a lip 79 (FIG. 7) of panel 78 engages an upturned portion of sliding core 18 to properly position panel 78.

Body 20 of front assembly 30 includes a first half 80 and a second half 82. Both first half 80 and second half 82 are preferably constructed as injection molded shells which are substantially similar to one another. First half 80 is coupled to second half 82 via a plurality of screws (not shown). Body 20 is divided into a forward compartment 84 and a rearward compartment 86 by a bulk head 88. Bulk head 88 includes provisions for retaining certain components of drive mechanism 26.

Drive mechanism 26 includes bit 14, a sleeve 90, a return spring 92, a retaining clip 94, coupling 42 and driveshaft 37. Return spring 92 circumscribes sleeve 90 and is positioned within forward compartment 86 to bias sliding core 18 away from body 20 toward the extended position. As shown in FIG. 2, body 20 includes a plurality of rectangular protrusions 100 selectively engageable with sliding core 18 to limit the travel of body 20 relative to sliding core 18.

Sleeve 90 includes a first end 104 having a flange 106 which is retained within slots formed in first half 80 and second half 82. A second end 108 of sleeve 90 and a portion of return spring 92 are slidingly supported by sliding core 18.

Bit 14 includes a first end 110 and a second end 112. First end 110 includes a tip 114 selectively engageable with the head of the fastener 16. Second end 112 includes a hexagonal section 116 which is drivingly coupled to driveshaft 37 positioned within extension tube 24. Bit 14 is positioned within sleeve 90 and retained therein by retaining clip 94. Driveshaft 37 provides torque to bit 14 via coupling 42. Retaining clip 94 restrains bit 14 from axially moving relative to sleeve 90 but allows rotational movement relative thereto. Based on the interconnections previously described, it should be appreciated that sleeve 90 and bit 14 axially translate with body 20 during operation.

As best shown in FIGS. 4 and 7, a detent spring 117 includes an arm portion 118 and an upset portion 120. Arm portion 118 is cantilever mounted to body 20. Detent spring 117 functions to require an operator of automatic screwfeeder 10 to purposely input a force greater than the weight of the screwfeeder to move body 20 and sliding core 18 toward the collapsed position. Incorporation of detent spring 117 assures that inadvertent driving or displacement of a screw positioned in a staged position 122 does not occur. To accomplish this goal, upset portion 120 is positioned within the path of an outer wall 124 of sliding core 18. As the external force is applied, outer wall 124 engages upset portion 120 and forces arm portion 118 to deflect thereby allowing sliding core 18 to collapse within body 20.

Figure 5:
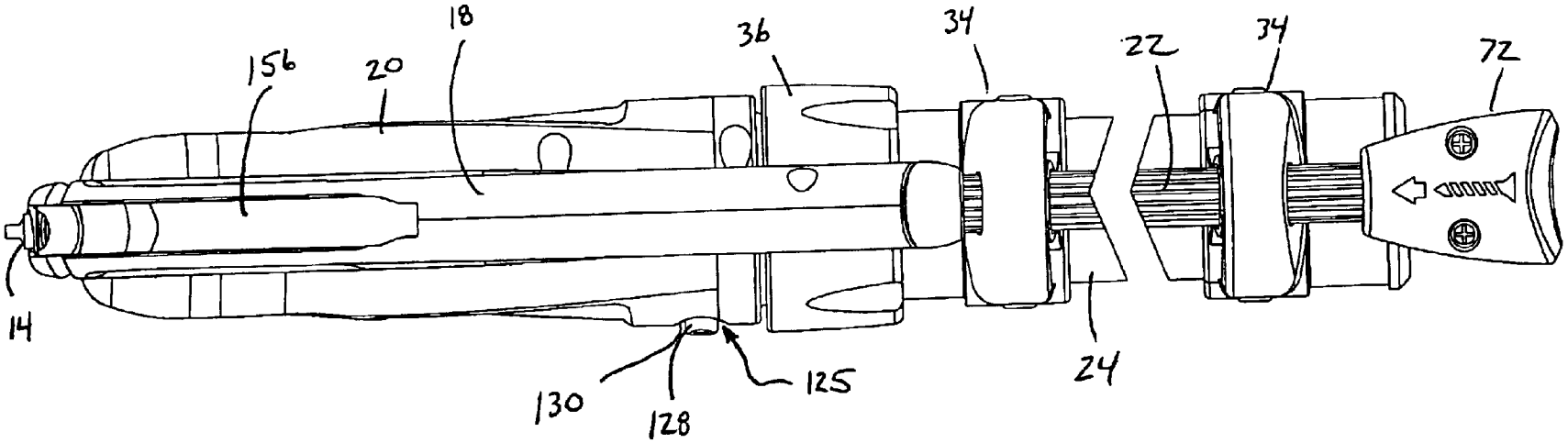
FIG. 5 is a top view of the automatic screwfeeder of the present invention.
Figure 6:
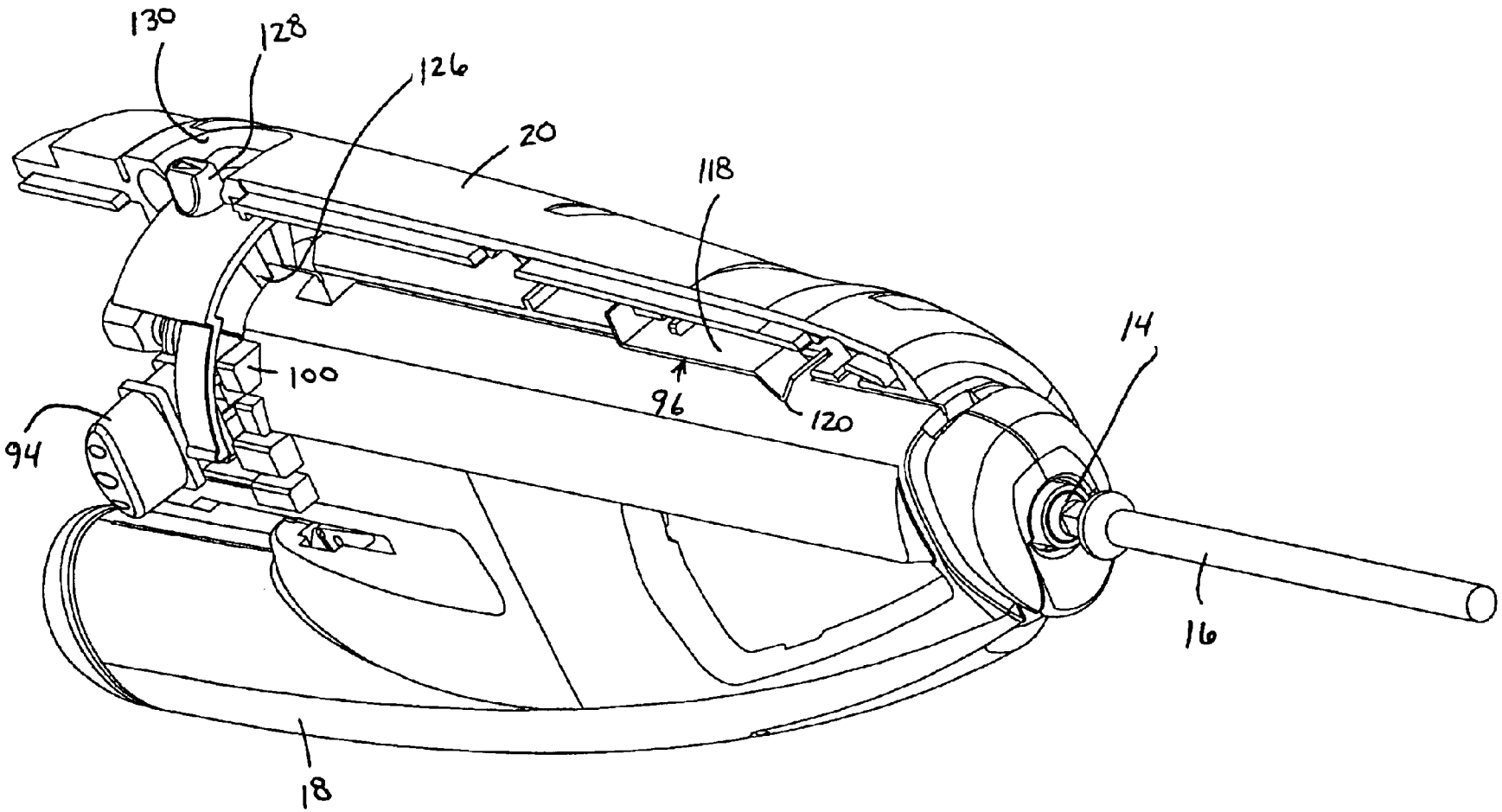
FIG. 6 is a fragmentary perspective view of the front assembly of the automatic screwfeeder of the present invention.

FIGS. 5 and 6 depict a depth stop 125 to include a series of annular stepped surfaces 126 which are selectably engagable with a portion of sliding core 18. Depth stop 125 includes a lever 128 protruding through an aperture 130 formed in body 20. Depth stop 125 is axially retained within body 20, but is free to rotate the arcuate distance defined by aperture 130. By rotating depth stop 125, stepped surfaces 126 rotate into and out of position for engagement with sliding core 18. Therefore, the travel of body 20 relative to sliding core 18 is limited by the position of depth stop 125. By limiting the travel of body 20 relative to sliding core 18, the fully extended position of bit 14 is defined. It is contemplated that the full range of adjustment varies ⅛". For example, a screw head may be counter-sunk 1/16" below a surface of the workpiece or may be positioned ⅛" below the plane of the work surface.

Sliding core 18 includes a first side 132 coupled to a second side 134 by a plurality of fasteners (not shown). Each of first and second sides 132 and 134 are preferably injection molded components in the shape of thin walled shells. As previously mentioned, sliding core 18 includes screw feed track 64 and bit bore 66. A toggle 140 of feeder mechanism 28 is biased toward the position depicted in FIG. 7 by a torsional spring 142. Toggle 140 is rotatable about a pin 144. Toggle 140 includes a first corner 146, a second corner 148 and a leg 150. First corner 146 and second corner 148 are in communication with screw feed track 64. Toggle 140 functions to selectively allow the threaded fasteners to enter staged position 122 where the screw 16 is coaxially aligned with the axis of rotation of bit 14. A magnet assembly 152 is positioned within a pocket formed within sliding core 18 to attract the head of screw 16 and retain the screw in staged position 122. Magnet assembly 152 includes a magnet 153 and a ferromagnetic cup 154.

Sliding core 18 includes a window 155 to provide access to staged position 122 and a portion of screw feed track 64. A translucent access cover 156 is pivotally coupled to sliding core 18 to selectively close window 155. Each side 132 and 134 of sliding core 18 includes a socket 158 for receipt of a trunion 160 extending from access cover 156. Sliding core 18 includes a groove 162 aligned with a recess 164 formed in access cover 156. An elastic band 166 is selectively disposed within groove 162 and recess 164 to retain access cover 156 in a closed position. If an operator desires access to staged position 122 or screw feed track 64, elastic band 166 is partially or completely detached to allow opening of access cover 156.

FIGS. 7–10 depict screwfeeder 10 at various positions during the process of driving screw 16 into a workpiece. Specifically, FIG. 7 depicts body 20 and sliding core 18 in a fully extended position. An exemplary screw **16*a* is shown located within screw accumulation tube 22 at a pre-staged position. In the pre-staged position, the head of screw 16*a* is engaged by second corner 148 of toggle 140. It should be appreciated that leg 150 of toggle 140 is clear of an outer surface 168 and an upper cam surface 170 of body 20 at this time. Torsional spring 142 biases toggle 140 in a counterclockwise direction and loads a detent 172 of toggle 140 against a seat 174 of sliding core 18**.

Figure 8:
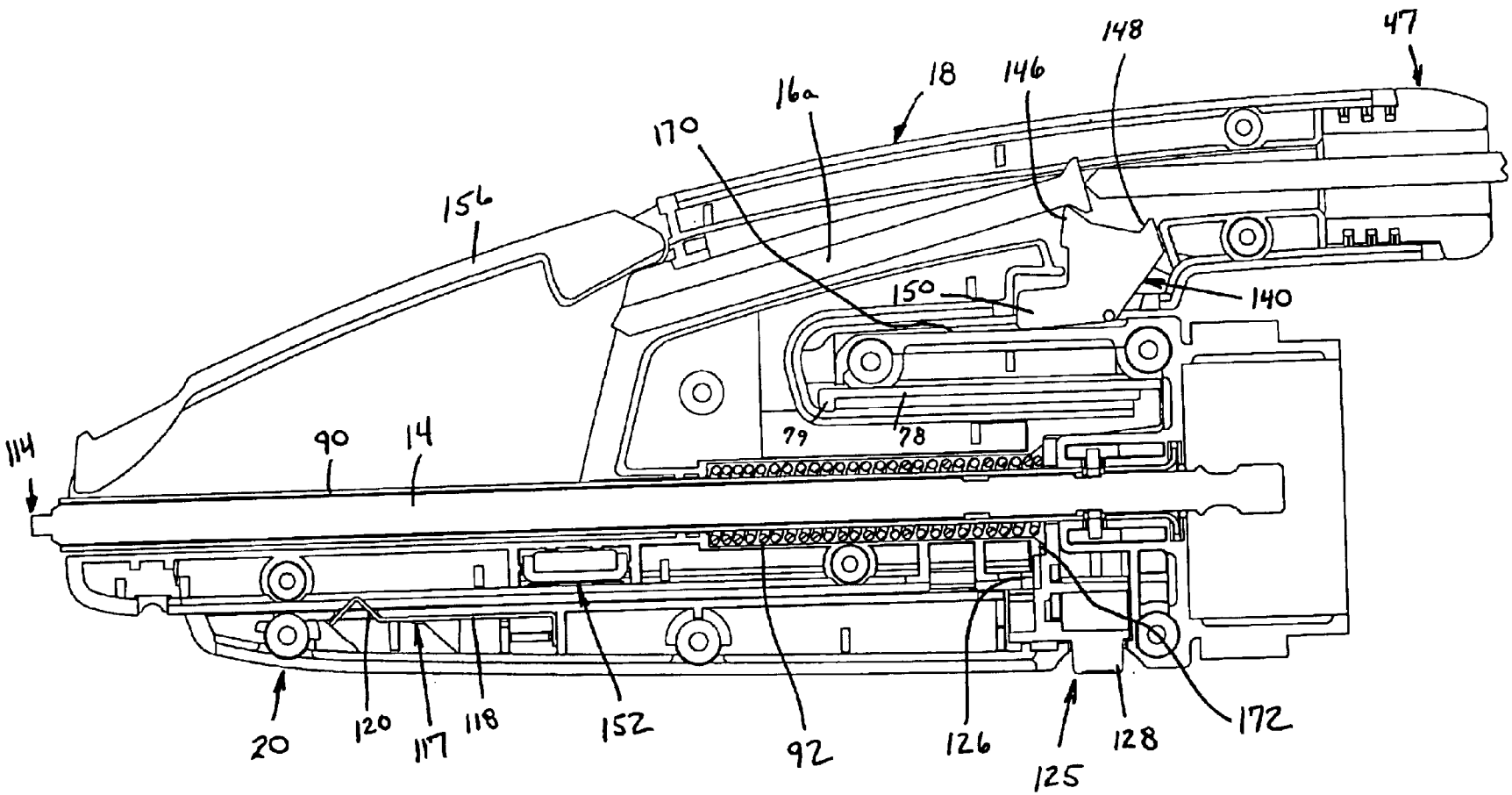

With reference to FIG. 8, sliding core 18 and body 20 are located in the fully collapsed position. The extent to which core 18 is allowed to telescope within body 20 is limited by depth stop 125. One of annular stepped surfaces 126 contacts an end face 172 of sliding core 18 at the fully collapsed position. At this time, bit 14 is fully extended and tip 114 protrudes from sliding core 18 and body 20. During relative movement of sliding core 18 and body 20, upper cam surface 170 engages leg 150 to rotate toggle 140 in a clockwise direction. Because the screws are being acted upon by gravity, screw 16*a* disengages second corner 148 and drops into engagement with first corner 146. The tip of a subsequent screw 16*b* engages the head of screw 16*a*.

Figure 9:
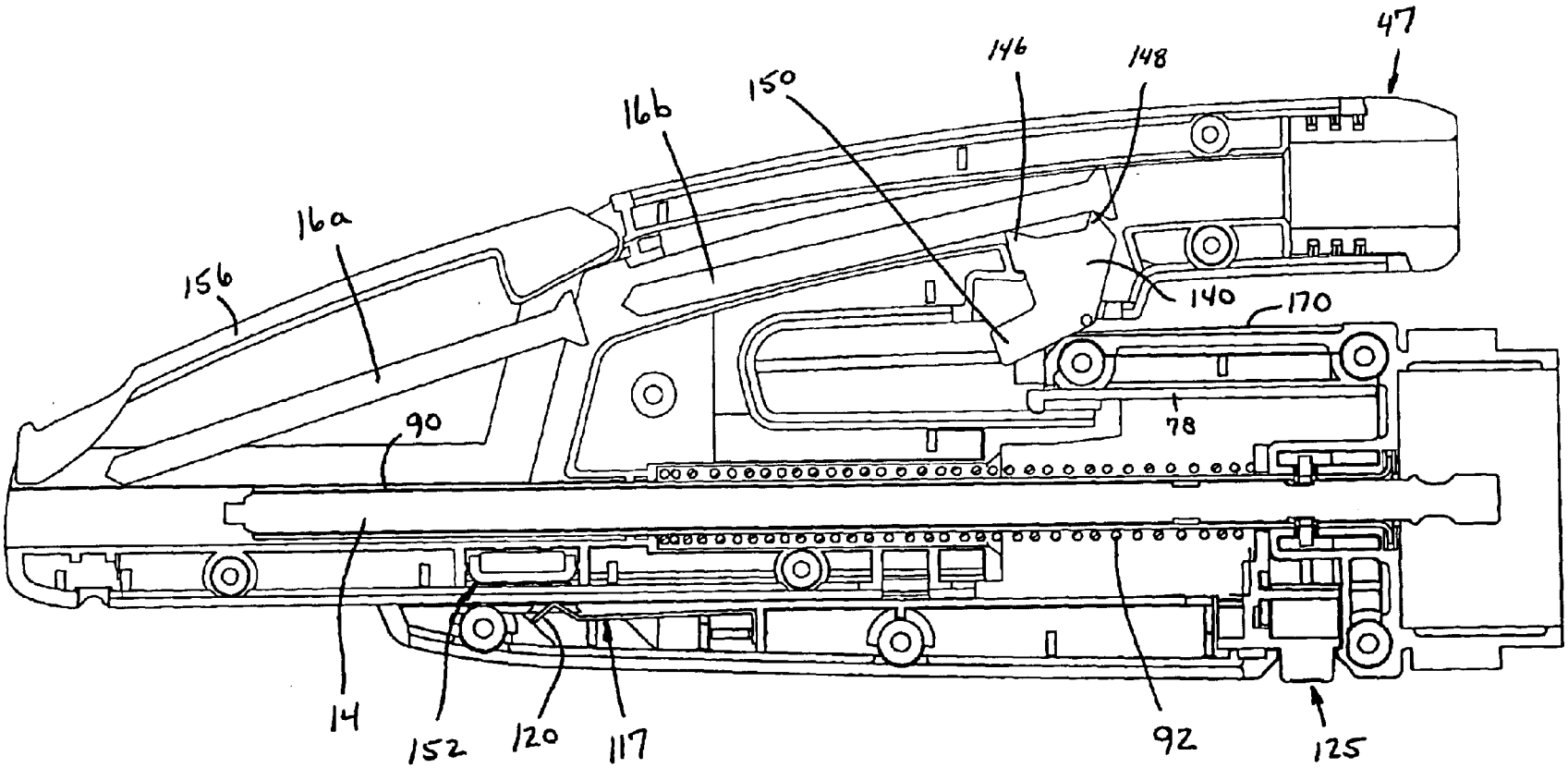

FIG. 9 depicts housing 20 and sliding core 18 moving from the collapsed position toward the extended position. During this movement, leg 150 disengages upper cam surface 170. Accordingly, toggle 140 rotates counter-clockwise to release screw 16*a* and capture screw 16*b*. Under the pull of magnet 152, the tip of screw 16*a* rides against sleeve 90 until it is retracted within bit bore 66.

Figure 10:
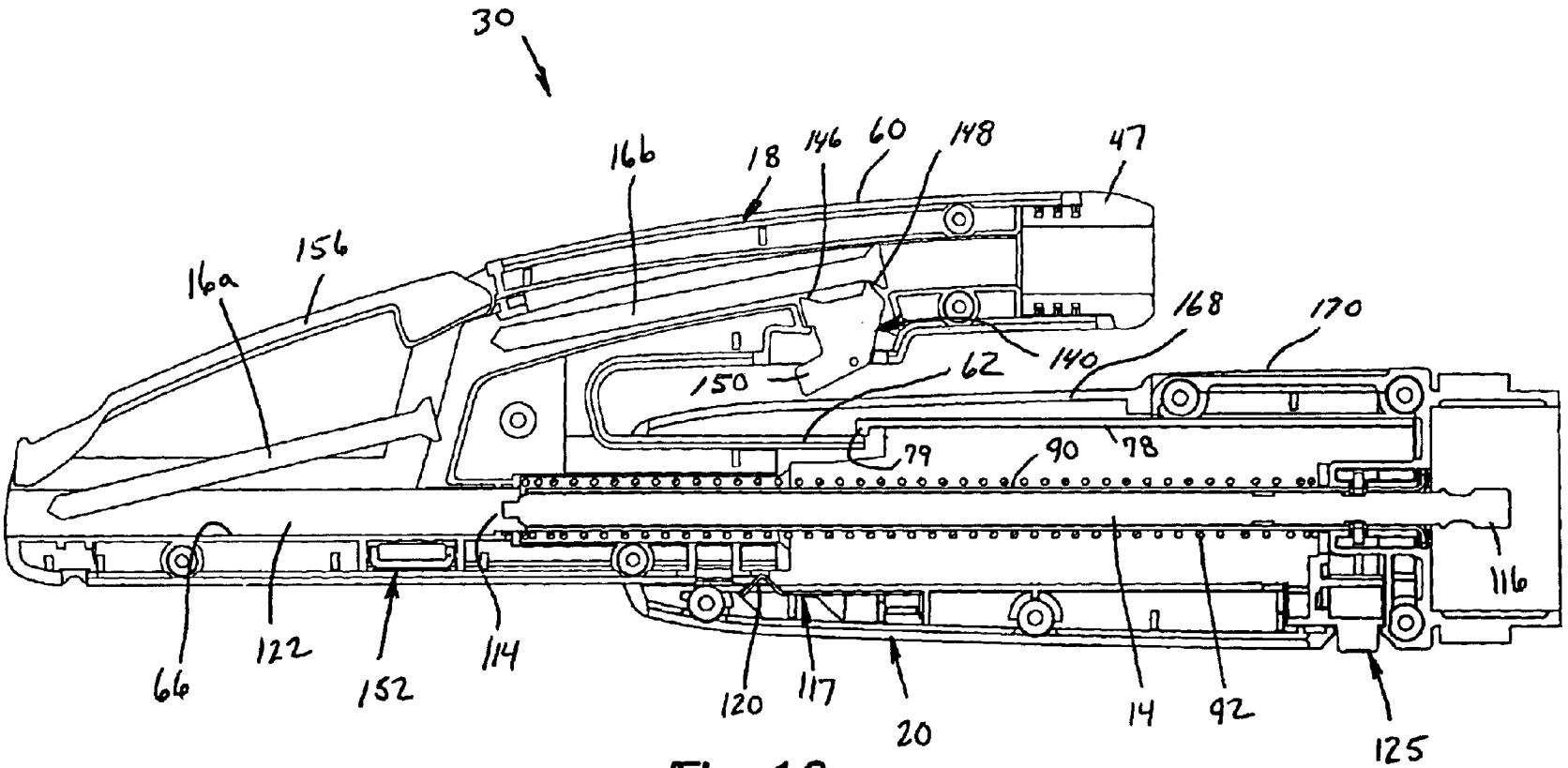

FIG. 10 shows sliding core 18 and body 20 positioned in the fully extended position. Sleeve 90 and return spring 92 are now clear of staged position 122. Therefore, magnet assembly 152 attracts screw 16*a* and orients it within bit bore 66. Screw 16*a* is now located within the staged position 122 where the screw's longitudinal axis is generally aligned with the rotational axis of bit 14. When an operator applies sufficient force to handle 44 and/or hand drill 12 to overcome detent spring 117, bit 14 engages screw 16*a* to simultaneously rotate and axially translate screw 16*a* into the workpiece. With a quantity of screws in the screw accumulation tube 22, the screw feeding and driving process may be rapidly repeated without requiring the operator to individually handle the screws or bend over from an upright or near-upright standing position.

Furthermore, the foregoing discussion discloses and describes merely exemplary embodiments of the present invention. One skilled in the art will readily recognize from such discussion, and from the accompanying drawings and claims, that various changes, modifications and variations may be made therein without department from the spirit and scope of the invention as defined in the following claims.

What is claimed is:

1. An automatic screwfeeder comprising:

a first assembly having a body, a core slidably coupled to said body and a bit rotatably supported by said body and said core, said bit being axially retained by said body within a bit bore and axially moveable relative to said core, said core including a screw feeding passageway in communication with said bit bore journal, wherein screws fed from said screw feeding passageway are generally aligned with said bit in a staged position prior to being driven;

a second assembly including a screw holder in communication with said screw feeding passageway, an extension tube spaced apart from said screw holder and a driveshaft, said driveshaft being positioned within said extension tube and selectively drivingly engageable with said bit; and a coupler rotatably captured on one of said first and second assemblies, said coupler being engageable with the other of said first and second assemblies to rigidly interconnect said first and second assemblies.

2. The automatic screwfeeder of claim 1 wherein said first assembly includes an access cover pivotally coupled to said core to allow access to screws located in said staged position.

3. The automatic screwfeeder of claim 2 wherein the access cover is translucent to allow an operator to view inside the automatic screwfeeder.

4. The automatic screwfeeder of claim 3 wherein said access cover pivots about an axis transverse to and offset from an axis of rotation of said bit.

5. The automatic screwfeeder of claim 1 wherein said body includes an aperture in receipt of a portion of said core.

6. The automatic screwfeeder of claim 5 wherein said core includes a tubular section which telescopes within a cavity formed within said body.

7. The automatic screwfeeder of claim 1 further including a magnet mounted to said core adjacent said staged position.

8. An automatic screwfeeder comprising:

a body;

a bifurcated core having first and second housing portions, said core being moveable from an extended position to a collapsed position, wherein said first housing portion of said core telescopically enters said body when said core is in said collapsed position, said second housing portion including a screw feeding passageway in communication with a bit bore of said first housing portion, wherein screws are fed from said screw feeding passageway to a location in communication with a bit positioned in said bit bore prior to being driven;

a screw holder coupled to said second housing portion in communication with said screw feeding passageway;

an extension spaced apart from said screw holder and coupled to said body; and a driveshaft positioned with said extension and selectively drivingly engageable with said bit.

9. The screwfeeder of claim 8 further including a filter coupled to an end of said screw holder, said filter including a plurality of spaced apart radially extending ribs.

10. The screwfeeder of claim 9 wherein said ribs include apertures at least some of which are not coaxially aligned.

11. The screwfeeder of claim 9 wherein said ribs include apertures of different size.

12. The automatic screwfeeder of claim 9 wherein said filter includes a first half and a second half, said first half including a portion of each of said radially extending ribs.

13. The automatic screwfeeder of claim 12 wherein said filter restricts screws from exiting said screw holder.

14. The automatic screwfeeder of claim 8 further including a depth stop rotatably coupled to said body, said depth stop including a plurality of stepped annular surfaces positioned within a cavity defined by said body, wherein one of said stepped surfaces selectively engages said core to define said collapsed position.

15. The automatic screwfeeder of claim 14 wherein said depth stop includes a radially extending lever extending through an aperture of said body, said lever being graspable by an operator to rotate said depth stop.

16. The automatic screwfeeder of claim 15 wherein rotation of said depth stop varies the position of said bit when said core is in said collapsed position.

17. The automatic screwfeeder of claim 8 further including an access cover pivotally coupled to said core to allow access to screws positioned within said core.

18. The automatic screwfeeder of claim 17 wherein said access cover rotates about an axis transverse to an axis of rotation of said bit.

19. An automatic screwfeeder comprising:

a body;

a core slidably coupled to said body, said core including a screw feeding portion and bit support portion, wherein relative movement of said core to said body transfers a screw from said screw feeding portion to said bit support portion, said screw being selectively engageable by a bit; and an access cover pivotally coupled to said core to allow access to said screws positioned in said core.

20. The automatic screwfeeder of claim 19 wherein said access cover rotates about an axis transverse to an axis of rotation of said bit.

21. The automatic screwfeeder of claim 20 further including a screw holder and an extension, said screw holder being coupled to said core and in communication with said screw feeding portion, said extension being coupled to said body and in communication with said bit support, said screw holder housing a plurality of screws.

22. The automatic screwfeeder of claim 21 further including a driveshaft positioned within said extension and drivingly coupled to said bit.

23. A method of operating an automatic screwfeeder including a first assembly and a second assembly, the first assembly having a core slidingly coupled to a body and a bit rotatably supported by the body, the second assembly having a screw holder, an extension and a driveshaft, the method comprising the steps of:

drivingly interconnecting the driveshaft and the bit;

coupling the extension to the body;

coupling the screw holder to the core;

inserting non-collated threaded fasteners within the screw holder, said threaded fasteners being substantially coaxially aligned; and selectively transferring one of said fasteners from the screw holder to a location within the core where said one fastener is selectively engageable with the bit.

24. The method of claim 23 wherein the step of coupling the extension to the body includes fastening a coupler to one of the extension and the body.

25. The method of claim 23 further including rotating a protruding lever of a depth stop to vary a depth the threaded fastener is driven, wherein a majority of the depth stop is positioned within the body.

26. The method of claim 25 further including detachably coupling the driveshaft to a hand drill.

27. The method of claim 23 further including sliding the body relative to the core to cause a portion of the core to telescopically enter the body.

28. The method of claim 27 wherein the step of sliding includes applying sufficient force to cause the core to engage and deflect a detent spring to allow further relative movement of the core and body.

29. The method of claim 27 wherein the step of sliding the body relative to the core includes engaging and disengaging a toggle with a portion of the body, said toggle being operable to selectively transfer said one fastener from the screw holder.

* * * * *